US007408567B2

(12) United States Patent
Ishikawa et al.

(10) Patent No.: US 7,408,567 B2
(45) Date of Patent: Aug. 5, 2008

(54) LIGHT BEAM SCANNING APPARATUS AND IMAGE FORMING APPARATUS

(75) Inventors: Daisuke Ishikawa, Shizuoka-Ken (JP); Koji Tanimoto, Shizuoka-Ken (JP); Kenichi Komiya, Kanagawa-Ken (JP); Yuji Inagawa, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 274 days.

(21) Appl. No.: 11/091,933

(22) Filed: Mar. 29, 2005

(65) Prior Publication Data

US 2006/0221172 A1 Oct. 5, 2006

(51) Int. Cl.
*B41J 2/435* (2006.01)

(52) U.S. Cl. ..... 347/246; 347/236

(58) Field of Classification Search ..... 347/128–133, 347/233–239, 241, 246–250, 251–254, 255, 347/229; 399/72; 358/1.13; 250/205
See application file for complete search history.

(56) References Cited

U.S. PATENT DOCUMENTS

| | | | | |
|---|---|---|---|---|
| 4,580,044 | A * | 4/1986 | Hongo et al. | 250/205 |
| 4,689,482 | A * | 8/1987 | Horikawa et al. | 250/205 |
| 4,978,976 | A * | 12/1990 | Okino | 347/235 |
| 5,793,406 | A * | 8/1998 | Trask et al. | 347/252 |
| 6,037,966 | A * | 3/2000 | Sakakibara | 347/252 |
| 6,052,141 | A * | 4/2000 | Takeuchi | 347/246 |
| 6,163,333 | A * | 12/2000 | Kamioka | 347/241 |
| 6,204,870 | B1 * | 3/2001 | Nakagawa et al. | 347/133 |
| 6,215,513 | B1 * | 4/2001 | Ashikaga | 347/252 |
| 6,222,580 | B1 * | 4/2001 | Yamada | 347/247 |
| 6,339,476 | B2 * | 1/2002 | Kajiwara et al. | 358/1.13 |
| 6,462,855 | B1 | 10/2002 | Komiya et al. | |
| 6,661,444 | B2 | 12/2003 | Komiya et al. | |
| 6,700,595 | B2 * | 3/2004 | Sugiyama et al. | 347/133 |
| 7,003,241 | B1 * | 2/2006 | Kobayashi et al. | 399/72 |
| 7,088,381 | B2 * | 8/2006 | Hirasawa | 347/234 |
| 2005/0007443 | A1 | 1/2005 | Komiya et al. | |

FOREIGN PATENT DOCUMENTS

JP 2002-028871 A 2/2005

OTHER PUBLICATIONS

U.S. Appl. No. 11/063,544, filed Feb. 24, 2005, Ishikawa et al.

* cited by examiner

*Primary Examiner*—Hai C Pham
(74) *Attorney, Agent, or Firm*—Foley & Lardner LLP

(57) ABSTRACT

An image forming apparatus is provided with a modulator producing a modulated signal of a pulse width decided on given image data and a driver driving an optical generator such as laser to generate a light beam. The image forming apparatus is further provided with a scanner periodically scanning the light beam generated by the optical generator and a power detector detecting information indicative of a power of the light beam scanned by the scanner. A pulse width adjustor uses the information detected by the power detector, in order to adjust the pulse width of the light beam.

10 Claims, 11 Drawing Sheets

LIGHT BEAM SCANNING APPARATUS AND IMAGE FORMING APPARATUS

BACKGROUND OF THE INVENTION

1. Technical Filed of the Invention

The present invention relates to a light beam scanning apparatus and an image forming apparatus, and in particular, to a light beam scanning apparatus in which a plurality of light beams, such as laser beams, are used to scan a single image carrying member for exposure thereof in forming an electrostatic latent image on the image carrying member and an image forming apparatus with this laser light scanning apparatus therein.

2. Related Art

Recently, a various-types of imaging forming apparatuses, such as digital copying machines and laser printers, have been developed and are now already in practical use, in which exposure scanning using a laser light beam (hereinafter, simply called "light beams") is combined with an electrophotography process to form images.

In the field of image forming apparatuses, there has recently been a stronger demand for forming images at higher speeds. As one means for responding to this demand, a multi-beam type of digital copying machine has been developed. This multi-beam technique enables a plurality of light beams to be generated to perform simultaneous scans along plural lines. Specifically, a plurality of semiconductor lasers are used to output plural light beams each guided to a photosensitive drum through reflections at several optical systems, and are scanned along the drum. In the image forming apparatuses each employing the multi-beam technique, pulse width modulation circuits, which produce drive signals by performing pulse width modulation (PWM) depending on image data, are disposed in driving paths for the plurality of semiconductor lasers, respectively.

On the other hand, a single-beam technique, which uses only one light beam for scanning, but is still able to cope with faster image formation, has been known as well. Examples based on this technique include the configuration disclosed by Japanese Patent Application No. 2004-168425. In this configuration, a single laser oscillator generating a scanning light beam is disposed and a plurality of transfer channels to the laser oscillator are formed to transfer image data thereto. Practically, a data processor is provided, in which image data supplied from a scanner section are subjected to predetermined image processing and digital image data of each line are distributed and outputted into two strings of image data (two data channels): a string of image data at odd-number-th pixels (called "odd pixels") and a string of image data at even-number-th pixels (called "even pixels"). This data processor further includes two serially connected circuits each having a pulse width modulation circuit and a driver, which process the image data composing each string. Both the laser drivers, each belonging to each data channel, have output terminals electrically connected to the single laser oscillator via, for example, a wired logical add (OR) circuit. In this circuitry, timings at which both the pulse width modulation circuits for the odd and even pixels output modulated signals respectively are mutually shifted by half an operation cycle of this circuit. This allows the pulse width modulation circuits to output the modulated signals at a speed which is double as fast as a maximum rated operation speed of each pulse width modulation circuit, thus forming images faster.

However, in any of the foregoing multi-beam and single-beam techniques, two or more pulse width modulation circuits are absolutely necessary. In particular, in the case of the multi-beam technique, two or more sets of circuits each including a pulse width modulation circuit, driver and laser are absolutely necessary. This means that there is larger influence of individual differences of the components. That is, even if instructions of the same amount are given, there are hardly provided PWM-modulated drive signals of the same pulse width, due to various factors such as individual differences of the pulse width modulation circuits, differences of positions at which light beams pass lenses, and errors in transmittance. That is, even though the same command values are given, accuracy in scanning is forced to be lowered and deterioration in the quality of images to be formed is inevitable as well. The above-said drawbacks due to the individual differences invite an increase in the rate of an error per dot, as the speed of the image forming operation becomes faster.

SUMMERY OF THE INVENTION

The present invention provides a light beam scanning apparatus and an image forming apparatus, which are able to have less influence of individual differences of circuit components.

According to the present invention, as one aspect, there is provided a light beam scanning apparatus comprising a modulator producing a modulated signal of a pulse width decided based on given image data; a light generator capable of generating a light beam in response to the modulated signal; a scanner periodically and spatially scanning the light beam generated by the light generator, along a second direction orthogonal to a predetermined first direction at a predetermine position in the first direction; a power detector detecting information indicative of a power of the light beam scanned by the scanner; and a pulse width adjuster adjusting a pulse width of the light beam to be generated based on the information detected by the power detector.

As another aspect of the present invention, there is provided a light beam scanning apparatus comprising modulation means for producing a modulated signal of a pulse width decided based on given image data; light generating means capable of generating a light beam in response to the modulated signal; scanning means for periodically and spatially scanning the light beam generated by the light generating means, along a second direction orthogonal to a predetermined first direction at a predetermine position in the first direction; power detecting means for detecting information indicative of a power of the light beam scanned by the scanning means; and pulse width adjusting means for adjusting a pulse width of the light beam to be generated based on the information detected by the power detecting means.

Furthermore, as another aspect of the present invention, there is provided an image forming apparatus comprising a modulator producing a modulated signal of a pulse width decided based on given image data; a light generator capable of generating a light beam in response to the modulated signal; a scanner periodically and spatially scanning the light beam generated by the light generator, along a second direction orthogonal to a predetermined first direction at a predetermine position in the first direction; a power detector detecting information indicative of a power of the light beam scanned by the scanner; and a pulse width adjuster adjusting a pulse width of the light beam to be generated based on the information detected by the power detector.

DETAILED DESCRIPTION OF PREFERRED EMBODIMENTS

A first embodiment of the present invention will now be described with reference to FIGS. 1 to 7. The present embodiment describes a light beam scanning apparatus according to the present invention and a digital copying machine serving as an image forming apparatus in which the scanning apparatus is arranged as part thereof. This digital copying machine may be reduced into practice as being a sole copying machine or part of an MFP (Multi-Functional Peripheral) system.

Figure 1:
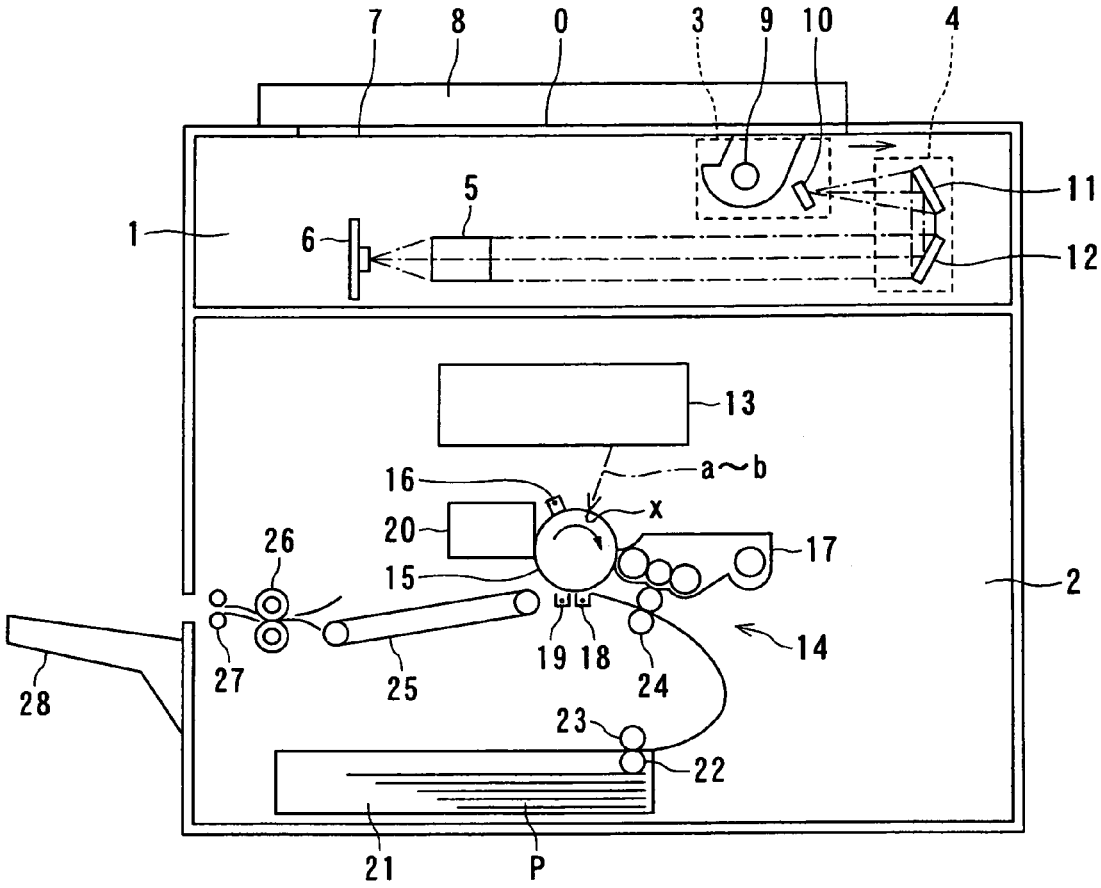
FIG. 1 is a view illustrating an outlined structure of a digital copying machine serving as an image forming apparatus according to embodiments of the present invention.

FIG. 1 pictorially shows the structure of the digital copying machine according to the present embodiment. This digital copying machine is, for example, configured to have a scanner section 1 serving as image reading means, and a printer section 2 serving as image forming means. The scanner section 1 is composed of various components including a first carriage 3 and a second carriage 4, which are movable along an arrow in the figure, a focusing lens 5 and a photoelectric conversion element 6.

As illustrated in FIG. 1, an original is placed, with its face downward, on an original table 7 formed of transparent glass. In this case, a benchmark to place originals O is decided such that the frontal right side of the original table 7 in the minor direction thereof is a central benchmark. An original holding cover 8, which is open/close-operable by a user, holds the original O on the original table 7.

The original O on the table is illuminated by a light source 9. The reflected light from the original O is converged onto a light-receiving surface of the photoelectric conversion element via mirrors 10, 11 and 12 the focusing lens 5. The first carriage 3 with the light source 9 and mirror 10 disposed therein and the second carriage 4 with the mirrors 11 and 12 disposed therein are designed to move at speeds of a relative speed ratio of 2:1 so as to keep the optical path length constant. Both of the first and second carriages 3 and 4 are driven by a carriage drive motor (not shown) in synchronism of a read timing signal to be provided, so that the carriages are moved from the right to the left in the figure shown in FIG. 1.

Images of the original O placed on the original table 7 are consecutively read line by line the scanner section 1. Resultant read-out outputs are then sent to an image processor 57 (refer to FIG. 3), where the outputs are converted to, for example, 8-bit digital image signals representing image densities.

The printer section 2 is equipped with an optical-system unit 13 and an image formation unit 14 being combined with the optical-system unit and operating on an electrophotography technique allowing images to be formed on a paper sheet P serving as a medium on which images are formed. Thus image signals from the original O, which responds to the read-out operations at the scanner section 1, are subjected to processing at the image processor 57 (refer to FIG. 3). The processed image signals are then converted to laser light beams (hereinafter referred to merely as "light beams") to be emitted from semiconductor laser oscillators (hereinafter referred to merely as "lasers") 31*a* and 31*b* (refer to FIG. 2). In the present embodiment, a multi-beam system with two lasers is adopted, but this is not a definitive list. The multi-beam system can also be realized by using three or more lasers to be operative in parallel to each other.

Though a detailed description will be given later to the structure of the optical-system unit 13 in connection with FIG. 2, two lasers 31*a* and 31*b* are disposed in the unit 13. The two lasers 31*a* and 31*b* operate to emit light responsively to laser modulation signals provided from pulse width modulation (PWM) circuits 70*a* and 70*b* (refer to FIG. 3), respectively. The emitted light beams travel respectively via optical systems 33 and 34 to arrive at a polygon mirror 35, by which the light beams are reflected to form scanning light beams emitting out of the unit 13.

The light beams transmitted from the optical-system unit 13 are focused as scanning light beams of spots each having a resolution necessary at an exposure location X (refer to FIG. 1) on a photosensitive drum 15 serving as an image carrying member. The scanning light beam is scanned to move its spot on the surface of the photosensitive drum 15, resulting in forming an electrostatic latent image on the photosensitive drum 15 depending on the read-out image signals.

As shown in FIG. 1, around the photosensitive drum 15, there are provided a charger 16 for charging the surface of the drum 15, a developer 17, a transfer charger 18, a separating charger 19, a cleaner 20, and other members. The photosensitive drum 17 is driven by a drive motor (not shown) to rotate at a predetermined circumferential speed, during which rotation the drum is charged by the charger 16 positioned to face the surface to be scanned of the drum. The foregoing light beam (scanning light beam) is focused as a spot at the exposure location X on the charged photosensitive drum 15.

The resultant electrostatic latent image on the photosensitive drum 15 is then developed into a toner image with the aid of a toner (developing agent) supplied from the developer 17.

At a transfer position, the toner image formed on the drum 15 is transferred by the transfer charger 18 onto a paper sheet P fed from a paper feed system on a timing-controlled basis.

The foregoing paper feed system is configured to feed paper sheets P to the image forming unit, one by one, in a separated manner realized by means of both a feed roller 22 and a separation roller 23. The paper sheets are contained in a paper feed cassette 21 located at a bottom portion of the apparatus. Each paper sheet from the paper feed cassette is fed to register rollers 24, in which the sheet is forced to reach a transfer position at a predetermined timing. On the downstream side of the transfer charger 18, arranged are a sheet convey mechanism 25, a fixing unit 26, and output rollers 27 outputting sheets P on which images are formed. Hence a paper sheet P with a toner image formed thereon is subjected to fixing at the fixing unit 26, before being delivered via the output rollers 27 onto a sheet output tray 28 secured on an outer side of the apparatus.

After completing the transfer of the image to the paper sheet P, the photosensitive drum 15 undergoes an operation at the cleaner 20, through which the residual toner on the drum surface is removed to return to its initial non-charge state. Hence the drum becomes ready for the next image formation.

Repeating the above processes makes it possible to perform image formation consecutively. That is, images of each original O placed on the original table 7 are read as image data by the scanner section 1, the resultant image data is subjected to the series of processes in the printer section 2, and recorded on a paper sheet P as a toner image.

The optical-system unit 13 will now be described.

Figure 2:
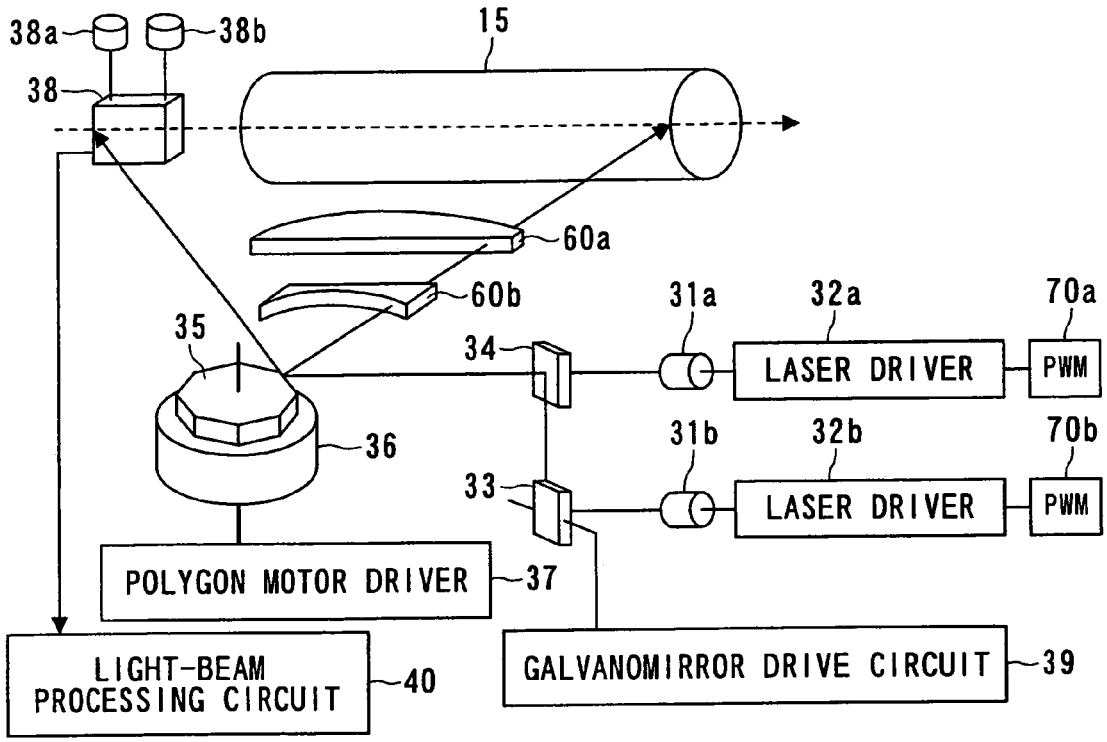
FIG. 2 is an outlined view explaining the configuration of an optical system of the digital copying machine according to a first embodiment.

FIG. 2 shows the configurations of the optical-system unit 13 and a positional relationship of the photosensitive drum 15 with the unit 13. As described, the optical-system unit 13 is provided with, by way of example, the lasers (semiconductor laser oscillators) 31*a* and 31*b* that serve as two light-beam generating means. The lasers 31*a* and 31*b* are driven in parallel for forming images along individual scanning lines, respectively. That is, the lasers 31*a* and 31*b* are assigned to simultaneous formation of images along two scanning lines. This way leads to fast formation of images, without increasing excessively the number of rotations of the polygon mirror 35 serving as a multi-surface rotation mirror.

The lasers 31*a* and 31*b* are driven individually by the laser drivers 32*a* and 32*b*. The light beam emitted from one of the lasers, 31*a*, passes a collimating lens (not shown) and then passes the half-mirror 34, before entering the polygon mirror 35. In a similar way to this, the light beam emitted from the remaining laser 31*b* passes a collimating lens (not shown) and then passes both of the galvanomirror 34 and the half-mirror 34, before entering the polygon mirror 35.

The polygon mirror 35 is driven to rotate at a constant speed, in which a polygon motor 36, which receives a drive signal from a polygon motor driver 37, performs the rotation of the polygon mirror 35. This allows the emitted light beams from the polygon mirror 35 to be scanned along a predetermined direction at an angular speed defined by the number of rotations of the polygon motor 36. The light beams to be scanned by the polygon mirror 35 are given a f-θ characteristic of a not shown f-θ lens through which the beams are traveled. Hence the f-θ lens enables scanning of the beams along scanning lines each running on both a light-receiving surface of the light-beam detector 38 and the surface of the photosensitive drum 15 at the constant speed. The light beam detector 38 thus functions as light-beam position detecting means, light-beam passage timing detecting means, and light-beam power detecting means.

In addition, the laser drivers 32*a* and 32*b* both are provided with auto-power control (APC) circuits, respectively, in which the lasers 31*a* and 31*b* are controlled to emit light under the same power condition at any time. In other words, a comparison is made between a detected output from a light-amount sensor (i.e., PD: photodiodes) incorporated in each laser oscillator and an emission power level instructed by a main controller (including a CPU) (refer to FIG. 3) and the emission control is carried out to keep those amounts equal to each other.

The light beams emitted from the lasers 31*a* and 31*b* are mutually combined by the half-mirror 34, so that the combined two light beams travel to the polygon mirror 35. Accordingly, the two light beams are able to scan the surface of the photosensitive drum 15 at the same time. An electrostatic latent image can be recorded at a speed two times larger than that on a signal-beam technique, provided that the number of rotations of the polygon mirror 35 is the same.

The galvanomirror 33 is arranged to adjust a positional relationship in a sub-scan direction between the light beam emitted from one of the lasers, 31*a*, and the light beam emitted from the other laser 31*b*. The sub-scan direction is defined as a direction orthogonal to a main scan direction and corresponds to the rotating direction of the photosensitive drum 15. To drive this galvanomirror 33, a galvanomirror drive circuit 39 is placed, the circuit operating responsively to a control signal from the main controller 51.

The light beam detector 38 is equipped with adjusting motors 38*a* and 38*b* to be used for adjusting the installation position of the detector and a tilt of the light beams to the scanning direction. The light beam detector 38 will be detailed in terms of its configuration together with a control system to be described later.

The control system will now be described.

Figure 3:
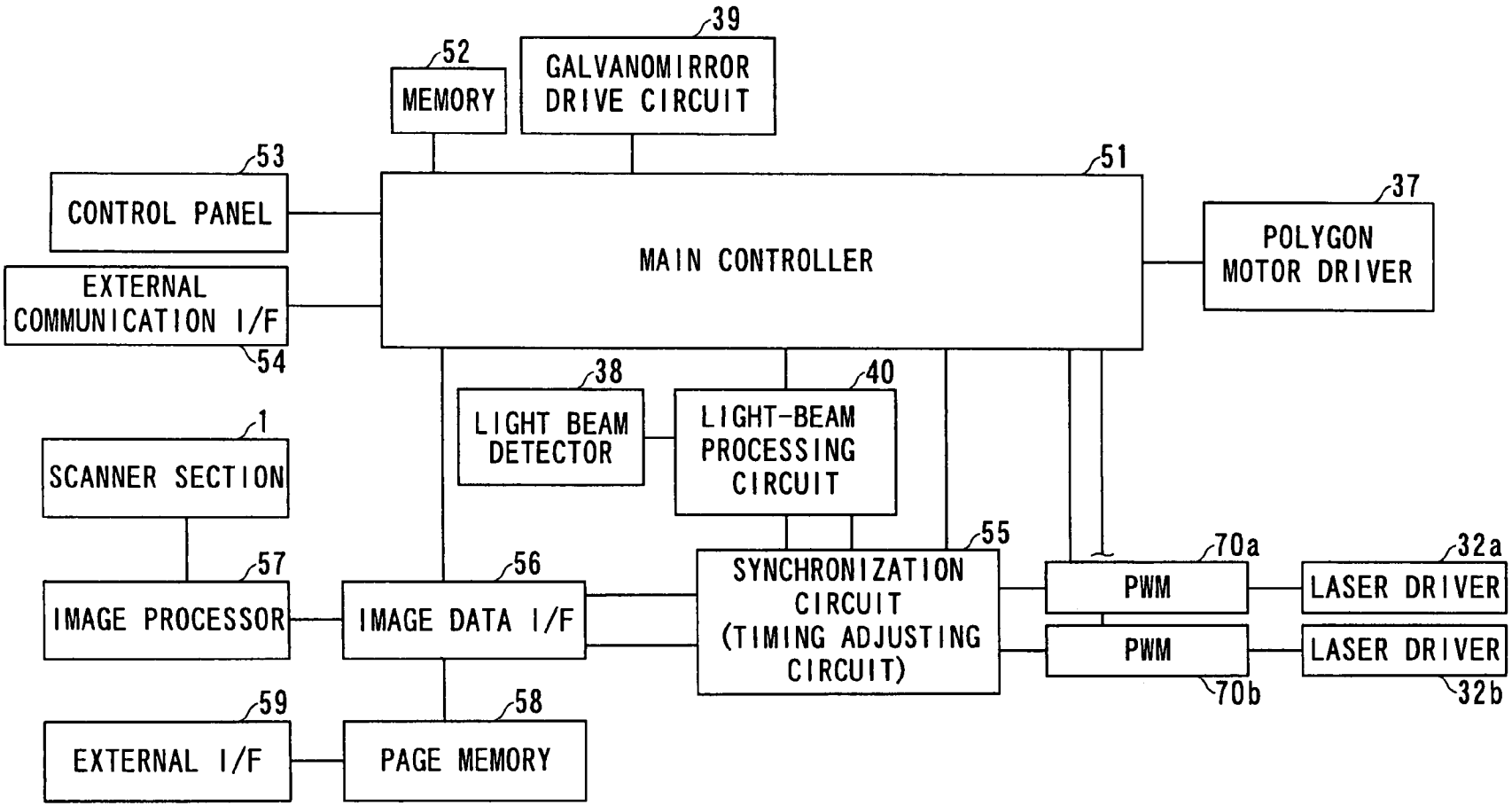
FIG. 3 is a block diagram explaining an outlined configuration of a control system of the digital copying machine according to the first embodiment.

FIG. 3 exemplifies a control system coping with an optical system based on the multi-beam technique. This control system is provided with the main controller 51 listed before, which is assigned to an electrical control of the apparatus. By way of example, the main controller 51 is structured to have, though not shown in the figure, a CPU (central processing unit), memories, a clock circuit and others. Further, various components are electrically connected to this main controller 51, such components including a memory 52, a control panel 53, an external communication interface (I/F) 54, the laser drivers 32*a* and 32*b*, the polygon-mirror motor driver 37, the galvanomirror drive circuit 39, the light-beam processing circuit 40, a synchronization circuit 55, and an image data interface (I/F) 55.

Additionally, the image data interface 56 is communicably connected with the synchronization circuit 55 and both of the image processor 57 and the page memory 58 are communicably connected to the image data interface 56. The scanner section 1 is communicably connected to the image processor 57, while the external interface 59 is communicably connected to the image memory 58.

Of these components, the light beam detector 38 is used to detect passage positions, passage timings, and power (amounts of light) of each of the foregoing two light beams to scan the photosensitive drum 15. The light beam detector 38 is disposed close to an end of the photosensitive drum 15 so that the light-receiving surface of the light beam detector 38 positionally agrees with the surface of the photosensitive drum 15. Signals detected by this light beam detector 38 are used to control the galvanomirror 33 reflecting each light beam (i.e., control of positions of images to be formed in the sub-scan direction), power (amounts of light) of light to be emitted by the lasers 31*a* and 31*b*, and timings when the lasers

31*a* and 31*b* emit light (i.e., control of positions of images to be formed in the main scan direction). The sensed signals outputted by the light beam detector 38 further include a signal representing a horizontal synchronization realized using the function of sensing the passage positions of the light beams.

To produce the signals for these kinds of control, the light beam detector 38 is communicably connected to the light-beam processing circuit 40. Hence, responsively to the various detected signals from light beam detector 38, the light-beam processing circuit 40 is able to provide both of the main controller 51 and a later-described laser controller 55 (refer to FIG. 3) with pulse signals (including a horizontally synchronizing signal BD) in which the passage positions, the power (amounts of light), and the passage timings of the light beams are reflected.

Figure 4:
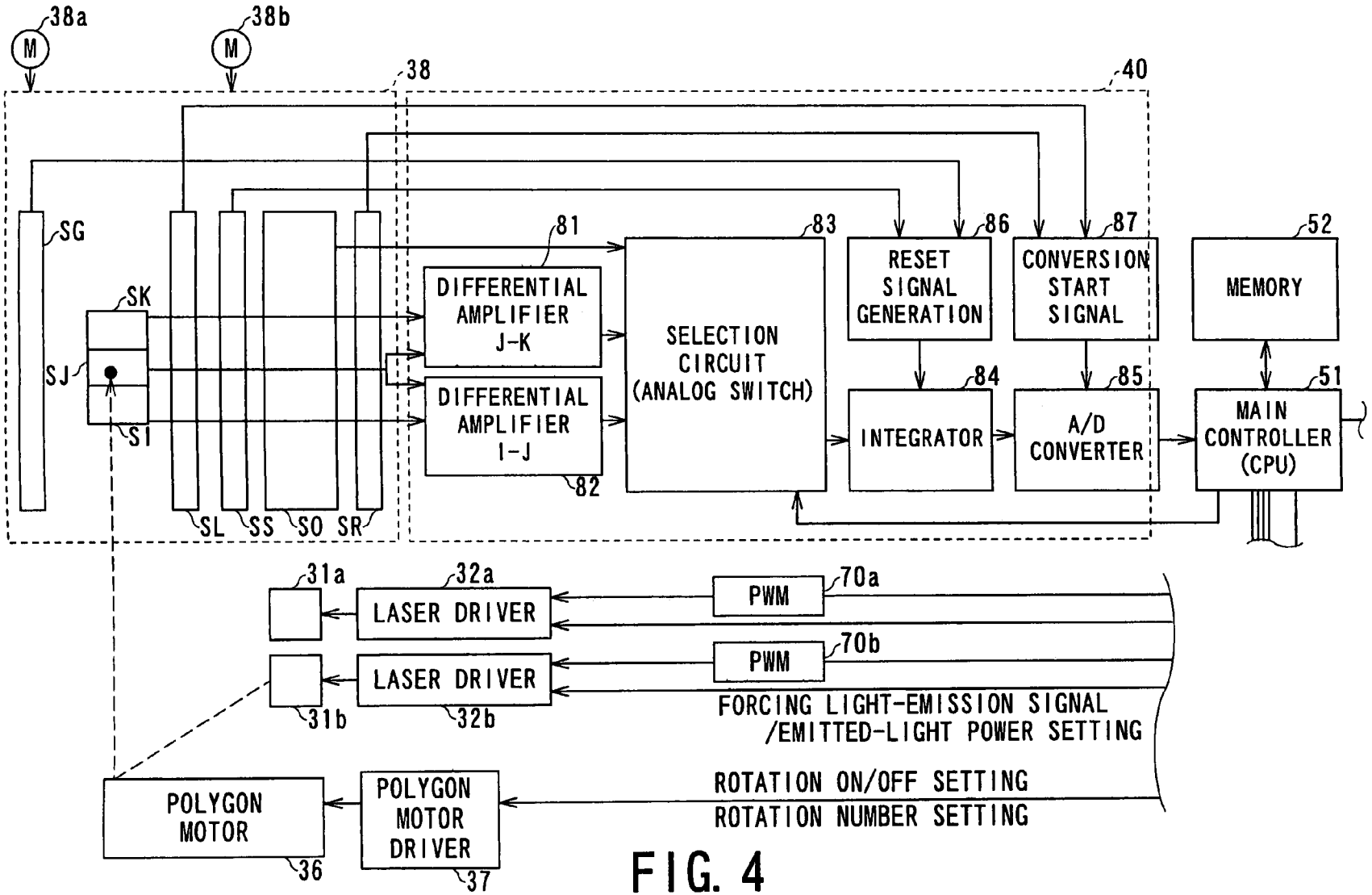
FIG. 4 is a block diagram outlining the configuration of a light-beam processing circuit and a light beam detector both belonging to the optical and control systems.

FIG. 4 exemplifies the circuitry of both of the foregoing light beam detector 38 and light-beam processing circuit 40, which is already known, but this is not always a definitive circuit configuration. As shown in FIG. 4, the light beam detector 38 has a holding substrate on which eight sensor patterns SG, SI, SJ, SK, SL, SS, SO and SR are formed rigidly. These sensor patters are formed of, for example, photodiodes which are mapped. When the light beams scan those sensor patterns, each photodiode converts optical energy to electrical energy and a not-shown current/voltage converter works to output its electrical energy as a voltage signal. The output voltage of each sensor pattern becomes zero, in response to completion of scanning the sensor pattern.

Of the above various sensor patterns, the sensor patterns SI, SJ and SK are mapped to be in parallel with each other at predetermined pitches in the sub-scan direction to the light beams. A position between the patterns SJ and SK provides a target position through which a first light beam passes, while a position between the patterns SJ and SI provides a target position through which a second light beam passes. Voltages outputted from the sensor patterns SJ, SI and SK are thus used to confirm that each light beam has passed each target position.

The sensor patterns SG and SS are formed to output voltage signals from which a reset signal is produced for an integrator to be described later. The sensor patterns SL and SR are formed to generate voltage signals from which a conversion-start signal to be given to an A/D converter (later described) is produced.

The remaining sensor pattern SO outputs a voltage signal used for deciding a range in which each laser 31*a* (31*b*) is driven to be switched on/off, pixel by pixel, while the light beam scans this pattern SO. That is, the region represents an image region in the scanned-line direction.

On the other hand, the light-beam processing circuit 40 is provided with a differential amplifier 81 receiving the voltage signals emanating from the sensor patterns SJ and SK, a further differential amplifier 82 receiving the voltage signals emanating from the sensor patterns SI and SJ, and a selection circuit 83 receiving two difference signals resultant from the differential operations in order to select either one signal from the two voltage signals that have been received. The selection circuit 83 switches its selecting operations every time when a selection signal is given from the main controller 51. The light-beam processing circuit 40 further comprises an integrator 84 to integrate the voltage signal selected by the selection circuit 83 and an A/D converter 85 to A/D-convert a value integrated by the integrator 84. The integrator 84 is formed to receive a reset (initialize) signal from the reset signal generator 86. This generator 86 generates the reset signal using the voltage signals from the foregoing sensor patterns SG and SS. The integrator 84 resets its integrated value in response to the reception of the reset signal, which makes it possible that the integrator 84 starts its integration at the next sampling timing. On the other hand, the A/D converter 85 is configured to receive, from the conversion-start signal generator 87, a start signal for A/D conversion. The generator 87 generates the conversion-start signal using the voltage signals emanating from the foregoing sensor patterns SL and SR. Every time when the start signal is received, the A/D converter 85 starts its A/D conversion, so that the resultant digital signal (integrated value) is provided to the main controller 51.

Referring to FIG. 3 again, a description will be made. When a copying action is performed as described, images of an original O placed on the original table 7 are read by the scanner section 1, and then the read-out data is sent to the image processor 57. In the image processor 57, the image data from the scanner section 1 undergoes various types of known data processes, such as shading correction, a variety of types of filtering, gradation processing, and gamma correction. The image data which has experienced such processes is then sent to the image data interface 56. This interface 56 is configured such that it has a function of selectively distributing the received image data to the two laser driver 32*a* and 32*b*. The thus-distributed image data is then provided to the synchronization circuit 55.

The synchronization circuit 55 generates a clock which is in synchronism with a timing at which each light beam passes across the light beam detector 38. Further, the synchronization circuit 55 uses this clock such that the two-line image data transferred from the image data interface 56 is made synchronous with the clock to output the mutually synchronous two-line image data to the pulse width modulation (PWM) circuits 70*a* and 70*b*, respectively. Each of the pulse width modulation circuits 70*a* and 70*b* performs pulse width modulation on the received image data, and then a resultant modulated output is sent as a drive signal to each of the laser drivers 32*a* and 32*b*.

The synchronization circuit 55 further includes a sampling timer, specific logic circuits, and others. The sampling timer is a device that makes the lasers 31*a* and 31*b* forcibly emit light during scanning of a non-image region of the drum, with the power of each light beam controlled. The specific logic circuits, which are arranged for adjusting imaging formation timings for each light beam, operate to make the respective lasers 31*a* and 31*b* emit light on the light beam detector 38 in the order of the light beams.

The control panel 53 is formed into a man-machine interface for activating a copying action and for giving the number of sheets to be copied, and for other performances.

In the case of the present digital copying machine, the actions carried out therein will not be limited to the copying actions. Since externally produced image data can enter this machine via the external interface 59 connected to the page memory 58, such image data can be formed and outputted in and from this machine. The image data received through the external interface 59 is temporarily stored in the page memory 58, and then sent to the synthesizing circuit 55 via the image data interface 56. In cases where the instant digital copying machine is controlled by external commands to be transmitted through, for example, a network, the external communication interface 54 will realize the functions of the control panel 53.

The galvanomirror drive circuit 39 is configured to drive the galvanomirror 33 in compliance with command values issued by the main controller 51. Hence the main controller 51 is able to arbitrarily control the angle of the galvanomirror 33 by controlling the drive of the galvanomirror drive circuit 39.

The polygon motor driver 37 is a member driving the polygon motor 36, which causes the polygon mirror 35 to rotate to scan the foregoing two light beams. The main controller 51 commands this polygon motor driver 37 to start and stop the rotation and control the number of rotations. This rotational number control is carried out, according to need, provided it is determined that the number of rotations should be reduced less than a predetermined number of rotations. The determination is done when the passage positions of the light beams are detected by the light beam detector 38.

Other than the operations for emitting laser beams in response to modulated signals synchronous to the light beam scanning from the foregoing synthesizing circuit 55, the laser drivers 32*a* and 32*b* has a function of causing the lasers 31*a* and 31*b* to forcibly emit light in answer to a forcible light-emitting signal from the main controller 51. This signal is issued independently of the image data to be received.

The main controller 51 is able to specify amounts of power of light to be emitted by the respective laser 31*a* and 31*b* and to give the amounts of light to the laser drivers 32*a* and 32*b*. In the main controller 51, the amounts of power are specified depending on changes in process conditions, detected information indicative of the positions of passage of the light beams, and others.

The memory 52 memorizes bits of information necessary for the control. Such bits of information include amounts of control at the galvanomirror 33, a circuit characteristic (an offset amount of an amplifier) for detecting the passage positions of the light beams, and the order of coming of the light beams. Previously memorizing those bits of information makes it possible that the optical-system unit 13 is brought into a state in which images can be formed immediately after activating the power.

The operations and advantages of this digital copying machine according to the present embodiment will now be described. Since the whole operations of this machine have already been outlined, this section will focus on describing correction of irregularities in modulated outputs (i.e., PWM outputs) from the pulse width modulation circuits 70*a* and 70*b*, in connection with FIGS. 5 to 7.

Figure 5:
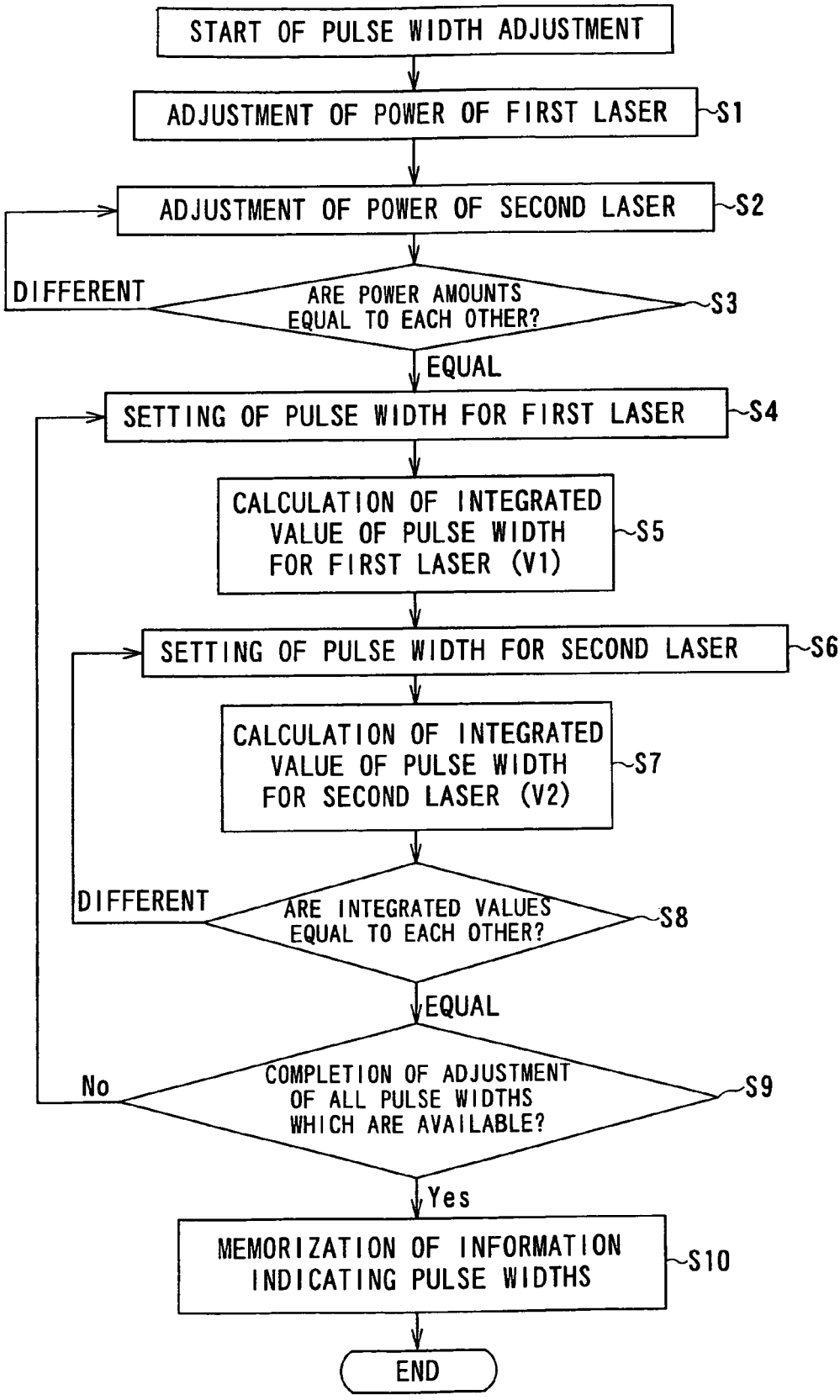
FIG. 5 is a flowchart outlining the processing for correction of irregularities in the width of a light beam pulse emitted line by line, the processing being executed by a main processor in the first embodiment.

The correction of the irregularities in the PWM outputs (i.e., adjustment of the pulse widths) is performed automatically under the control of the main controller 51 in response to an operator's command or a command issued during running a necessary inspection program. Such commands will be given when this digital copying machine is installed, a repair and maintenance inspection is carried out, or the power is put on for use of this machine. FIG. 5 outlines the processing for the irregularity correction.

Figure 6:
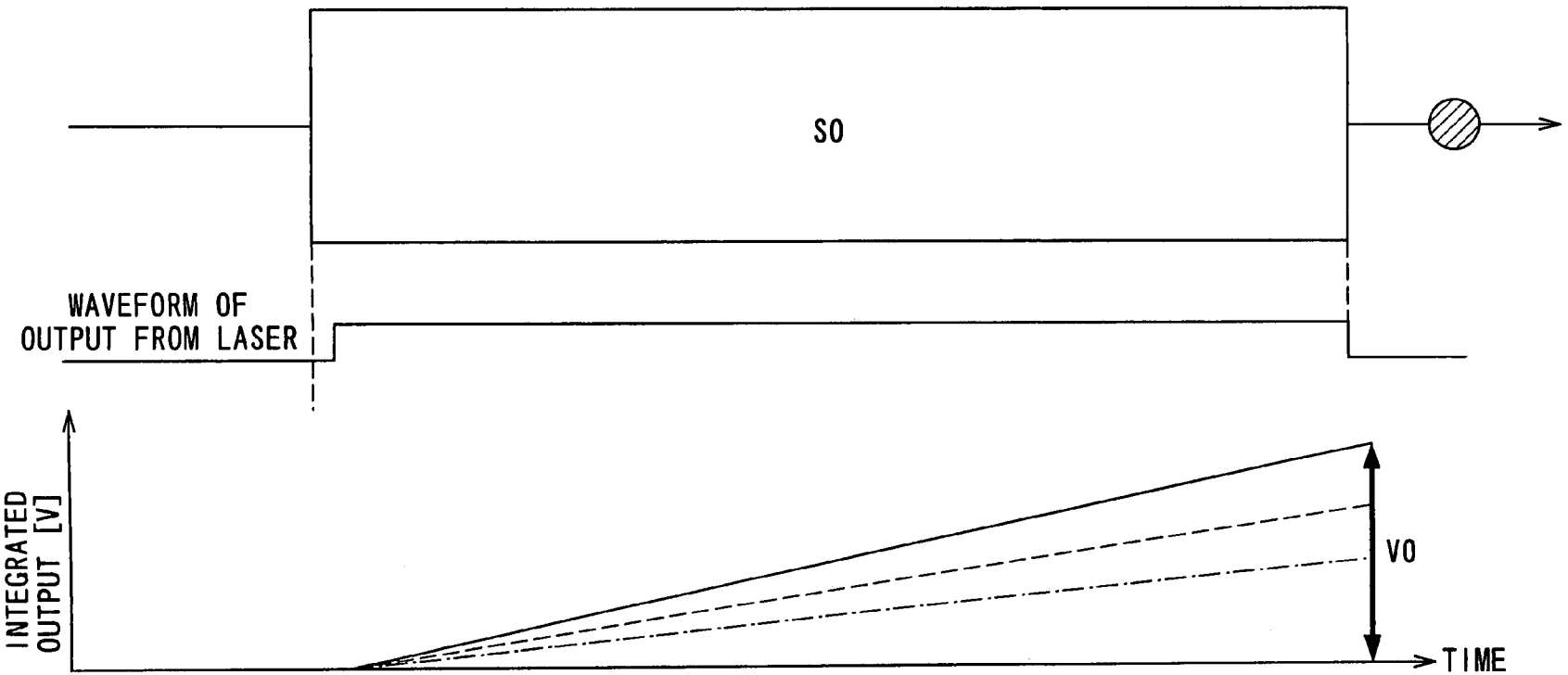
FIG. 6 is a view explaining adjustment of the power of the light beam.

When each light beam passes the sensor pattern SO of the light beam detector 38, which indicates the image region, an integrated value of the sensor output (i.e., integrated output) increases linearly as the passage time elapses, as shown in FIG. 6. Practically, for the continuous light emission at the laser 31*a* (31*b*), the integrated output is allowed to increase at a constant sensitivity (slope in the graph), as shown in FIG. 5. This sensitivity depends on amount of power of the light beam, in which the greater the power of the light beam, the larger the integrated amount VO.

When the multi-beam technique is employed, the light beams (that is, the lasers) are used a plurality of pieces, like the present embodiment. Therefore, it is required to previously adjust the amounts of power of those light beams to the same one.

Thus the main controller 51 commences the correction of irregularities in the PWM outputs (corresponding to adjustment of the drive pulse widths). In this correction, at first, the power of the first laser 31*a* is adjusted (step S1), which is followed by adjusting power of the second laser 31*b* (step S2). Then it is determined whether or not those power amounts are mutually equal (step S3). This determination is performed to see if the integrated value VO of the voltage signal from the sensor pattern SO of the light beam detector 38 is the same for both the lasers 31*a* and 31*b*, assuming that each of the lasers is driven to perform the scanning with its emitted light beam under the same conditions (for example, the laser is continuously driven to emit light). When the determination reveals that there is no agreement between the power amounts, the present embodiment activates the adjustment of the power of the second laser 31*b*. Specifically, to make the power of the second laser 31*b* equal to that of the first laser 31*a*, parameters at the pulse width modulation circuit 70*b*, laser driver 32*b*, and circuits of the second laser 31*b* are changed. Thus the similar adjustment and determination can be performed repeatedly. As a result, the power amounts of the light beams from the first and second lasers 31*a* and 31*b* can be set equally to each other (step S3, YES: that is, completion of the laser power adjustment).

Then, while the light beam is allowed to scan the sensor pattern SO of the light beam detector 38, the main controller 51 then sets a certain pulse width (refer to FIG. 7) to be used by the first laser 31*a* (step S4). The first laser 31*a* then emits light for each pixel at timings depending on the pulse width W1, during which time the laser beam is scanned along each line to calculate the foregoing integrated value V1 based on the sensor pattern SO (step S5).

Like the above, with respect to the second laser 31*b*, the main controller 51 sets a certain pulse width W2 to each pixel and calculates an integrated value V2 corresponding to the pulse width W2 (steps S6 and S7).

Figure 7:
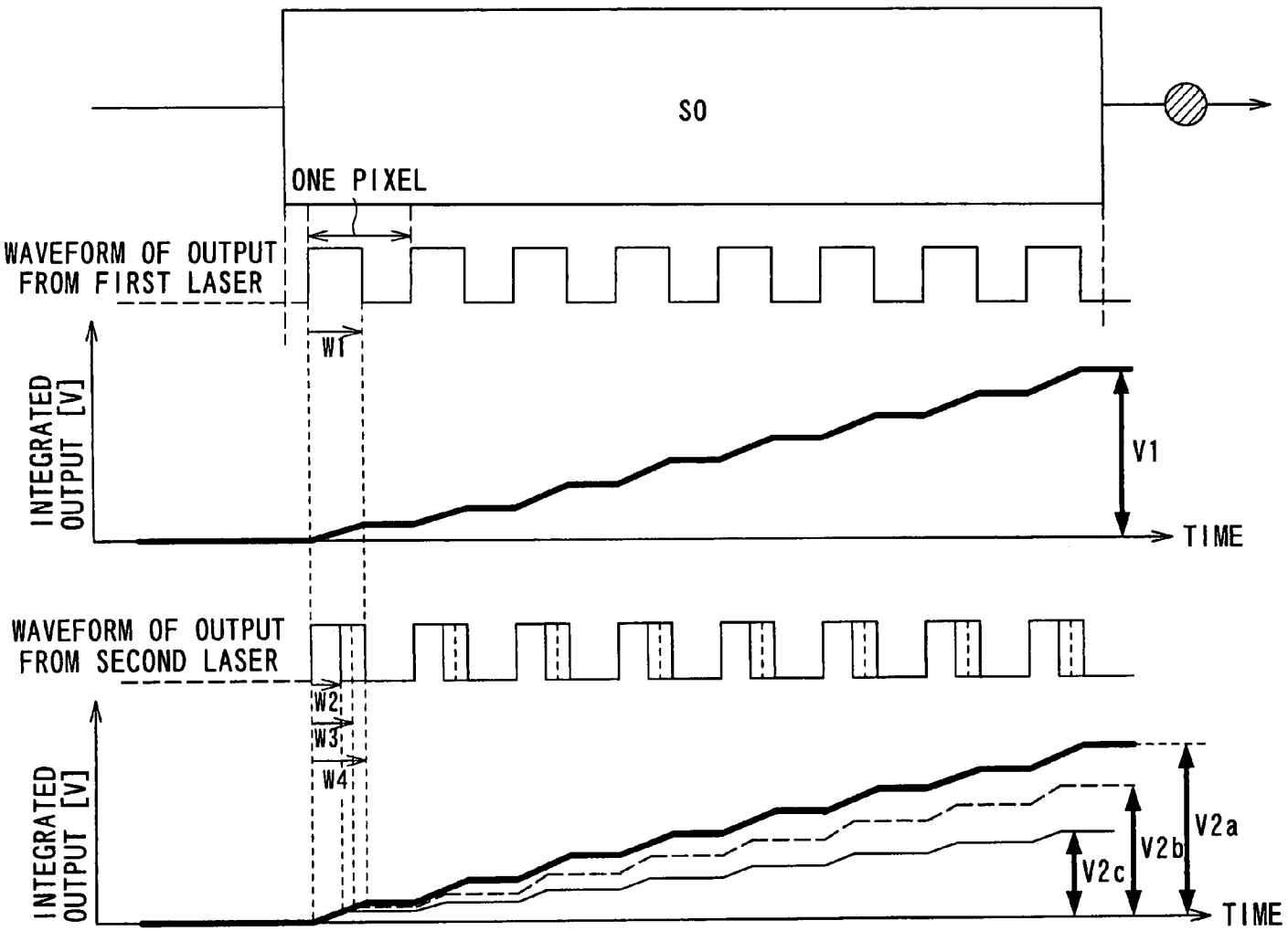
FIG. 7 is a view explaining correction of the irregularities in the width of the light beam pulse.

The main controller 51 then makes a comparison between the integrated values V1 and V2 for the first and second lasers 31*a* and 31*b* (step S8). As a result, if the comparison reveals that the pulse width W2 for the second laser 31*b* is smaller than the pulse width W1 for the first laser 31*a*, the integrated value V2*c* (=V2) based on the second laser 31*b* becomes lower than the integrated value V1 based on the first laser 31*a*, as shown in FIG. 7. By contrast, if the opposite compared result to the above, that is, the pulse width W2 for the second laser 31*b* is larger than the pulse width W1 for the first laser 31*a*, the integrated value V2 based on the second laser 31*b* is over the integrated value V1 based on the first laser 31*a*.

Thus the main controller 51 returns the processing to step S6, at which the main controller re-sets the pulse width W2 assigned to each pixel to be produced by the second laser 31*b*. In this re-setting operation, when the determination of V2(=V2*c*)<V1 was made in the last time, the pulse width W2 is increased by a predetermined amount in this time of processing. Practically, the re-setting of W3=W2+ΔW is done. Hence, by way of example, as long as the determination of V2<V1 is continued at step S8, the pulse widths W3 and W4 for each pixel based on the second laser 31*b* are re-set to grow in sequence.

Every time this re-setting operation is carried out, the main controller 51 calculates, at step S7, the integrated values V2(=V2*b*, V2*c*, . . . ) corresponding to the pulse widths W3, W4, . . . for each pixel that has been re-set for the second laser 31*b*. In consequence, when both of the integrated values realizes a condition of V1=V2, the pulse width W1 for each pixel, which is to be produced by the light beam emitted by the first laser 31*a*, becomes equal to the pulse width W2 for each pixel, which is to be produced by the second laser 31*b* (in the example shown in FIG. 7, W1=W4), so that the determination at step S8 is YES. The equality referred herein still includes equality with a certain range of allowance. This series of processes described above are executed for every line to be used (step S9).

After this, the main controller 51 stores, into the memory 52, data indicative of the pulse widths W which have been adjusted to be equal to each other (step S10), before the irregularity correction (i.e., the pulse width adjustment) is terminated.

In this way, once the pulse width W has been set, it can be used by both of the pulse width modulation circuits 70*a* and 70*b*, respectively, as a reference value for actually forming images. Thus, in the formation of images, the pulse widths to be modulated according to image data in each of the pulse width modulation circuits 70*a* and 70*b* will surely comply with the reference value. The amounts of light to be emitted by the first and second lasers 70*a* and 70*b* are also in accordance with the common reference value.

In the present embodiment, the integrated values of voltage signals outputted from the sensor pattern SO (of the light beam detector 38) defining an image region are used as amounts that are correspondent to the amounts of light to be emitted by both of the first and second lasers 31*a* and 31*b*. And the integrated values resultant from the scans of the light beams emitted by the first and second lasers 31*a* and 31*b* are compared to each other, and the beam widths for the respective pixels become equal to each other. Thus the even pulse widths can be set to both of the laser driving systems, i.e, driving channels, the irregularities in the widths of the PWM pulses, which are attributable to individual differences of the systems each including the pulse width modulation circuit, laser driver, and laser, can be eliminated or lessened. Accordingly, a deterioration in image quality which is due to irregularities in depiction can be suppressed, whereby images of fine accuracy can be provided.

In the present embodiment, the functions depicted by each laser 31*a* (31*b*) include a function of depicting each pixel by the use of a divided pixel, which is an integral multiple of plural sections of one dot, such as 4 sections or 16 sections. Accordingly, it is preferable that the increment to the pulse width for each pixel produced by the second laser 31*b* agrees with an increment to the above divided pixel.

Further, though the foregoing embodiment has adopted the way of adjusting the power and width of light emitted by the second laser 31*b* so as to agree with those of the first laser 31*a*, this adjustment can be done in the opposite way to the above. That is, the power and width of light emitted by the first laser 31*a* may be adjusted to agree with those of the second laser 31*b*. Alternatively, a power and a width of light to be emitted which are common criteria for the first and second lasers 31*a* and 31*b* may be set in advance, so that the actual power and width of light emitted by the respective lasers 31*a* and 31*b* can agree with those criteria.

Second Embodiment

Referring to FIGS. 8 to 11, a second embodiment of the present invention will now be described. In describing the second embodiment, the components identical or similar to those described in the first embodiment can be given the same reference numerals for the sake of more simplified explanations.

The second embodiment relates to an application of the irregularity correction of pulse widths according to the present embodiment to the pixels composing each scanning line.

Figure 8:
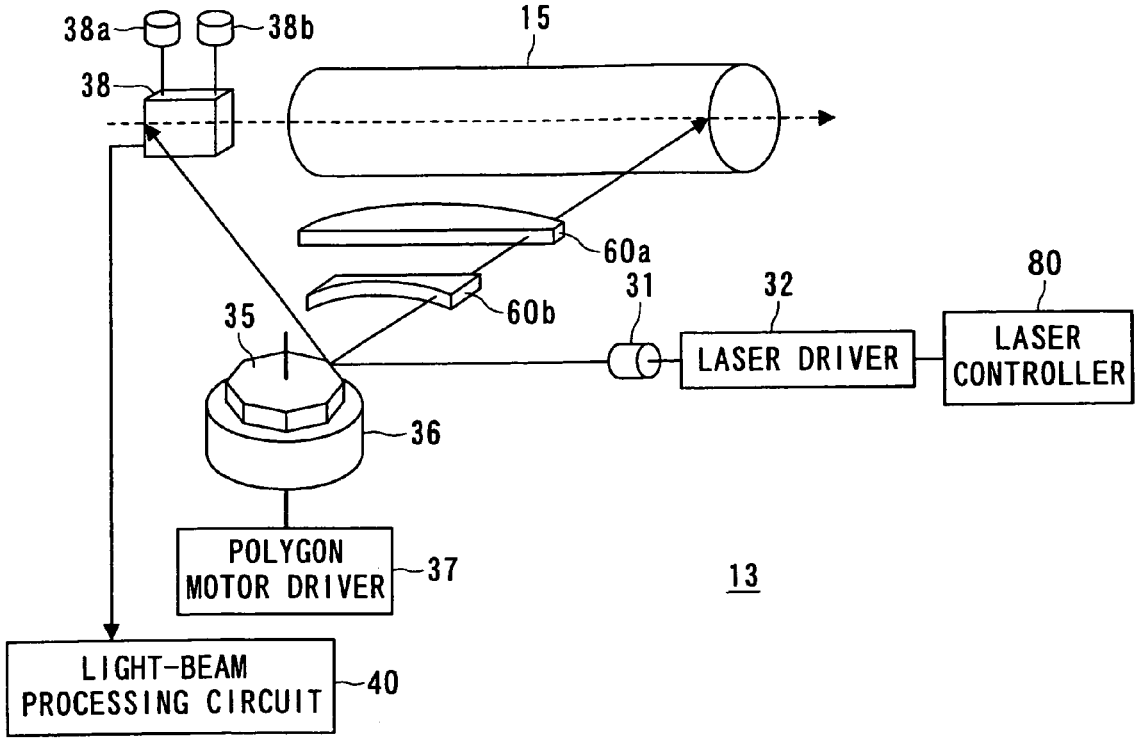
FIG. 8 is an outlined view explaining the configuration of an optical system of the digital copying machine serving as an image forming apparatus according to a second embodiment of the present invention.

The entire configuration of a digital copying machine according to this second embodiment is the same as that described in the first embodiment except that there are slight differences in the optical and control systems between the first and second embodiments. FIG. 8 shows an optical-system unit 13 which is incorporated in the digital copying machine. As shown therein, only a one laser 31 is disposed, and this laser 31 is driven by a single laser driver 32. This laser driver 32 is formed to receive a PWM drive signal from a laser controller 80. In addition, the light beam detector 38 is also modified such that it has only the foregoing pair of sensor patters SI and SJ in the sub-scan direction. The light-beam processing circuit 40 is modified to remove the one differential amplifier 81, with the other one 82 remained.

Figure 9:
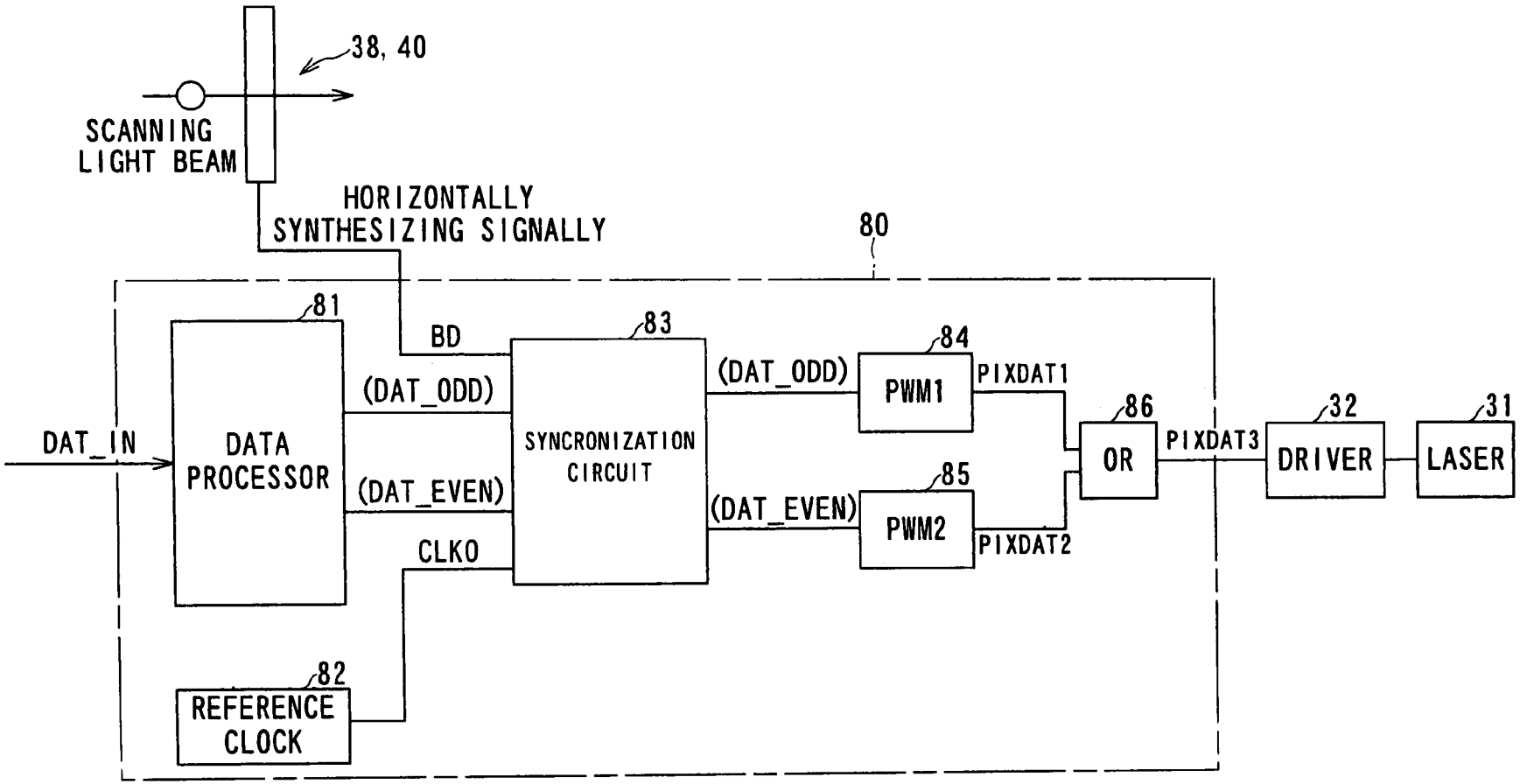
FIG. 9 is a block diagram explaining a laser controller of the digital copying machine according to the second embodiment.

The laser controller 80 employs the configuration shown in FIG. 9. Specifically, as shown in FIG. 9, the laser controller 80 is provided with a data processor 81 at the input stage thereof. This data processor 81 is provided with a multiplexer serving as data distributing means. Of these, the multiplexer has the configuration in which image data (DAT_IN) received from the image data interface 56 is distributed alternately into two strings (channels) consisting of a string of image data (DAT_ODD) formed of only odd pixels of the received image data and a string of image data (DAT_EVEN) formed of only even pixels of the received image data, so that the image data (DAT_ODD) and (DAT_EVEN) are outputted by turns.

Moreover, as shown in FIG. 9, the laser controller 80 is provided with a reference clock circuit 82, a synchronization circuit 83, a pulse width modulation circuit 84 for odd-pixel strings, a pulse width modulation circuit 85 for even-pixel strings and a logical odd (OR) circuit 86.

Of these, the reference clock circuit 82 outputs a reference clock of, for example, "1/16" corresponding to a minimum unit for division of one pixel (for example, 16-divisions). As a variation, this reference clock may be produced by dividing the system clock incorporated in the apparatus.

The synchronization circuit 83 receives the horizontally synchronizing signal BD provided from the light-beam processing circuit 40 to make both the image data (DAT_ODD, DAT_EVEN) for odd- and even-pixel strings synchronous with the horizontally synchronizing signal BD, and outputs both the image data to the pulse width modulation circuits 84 and 85, respectively, in a synchronous manner. In other words, image data at an arbitrarily specified odd pixel and image data at the next even pixel are made synchronous with each other, and then provided to the pulse width modulation circuits 84 and 85, respectively.

Each of the first and second pulse width modulation circuits 84 and 85 uses the inputted image data (DAT_ODD or DAT_EVEN) to modulate a pulse so that a modulated output (PIXDAT1 or PIXDAT2: a modulated pulse signal) depending on the pulse width modulation is produced. These modulated outputs (PIXDAT1 and PIXDAT2) are outputted to the next-stage OR circuit 86 to be synthesized with each other. In consequence, a pulse signal PIXDAT3 is produced, and transferred to the laser driver 32 as a PWM drive signal therefor. The laser driver 32 therefore consecutively receives the odd- and even-pixel paired pulse signal PIXDAT3, that is, the PWM drive signal, so what the driver is able to drive the laser 31 in an on/off manner by using the PWM drive signal.

The above configuration makes it possible that the pulse width modulation (PWM) technique is applied, respectively, to the odd-numbered pixels (odd pixels) and even-numbered pixels (even pixels) among each line of data in a set of scanned image data and the PWM output timing is shifted by half a cycle from each other between the odd pixels and the even pixels. Hence the image data can be transferred to the laser driver 32 at a clock rate that is double the maximum rated operation speed owned by the pulse width modulation circuits. It is possible to raise a light beam scanning speed.

By the way, the digital copying machine according to the present technique uses the plural pulse width modulators 84 and 85. For this reason, even when a command of the same pulse width is given to the one laser 31 between the odd and even pixels, there are some cases where the light beams fluctuate, resulting in images of poor fineness.

Figure 10:
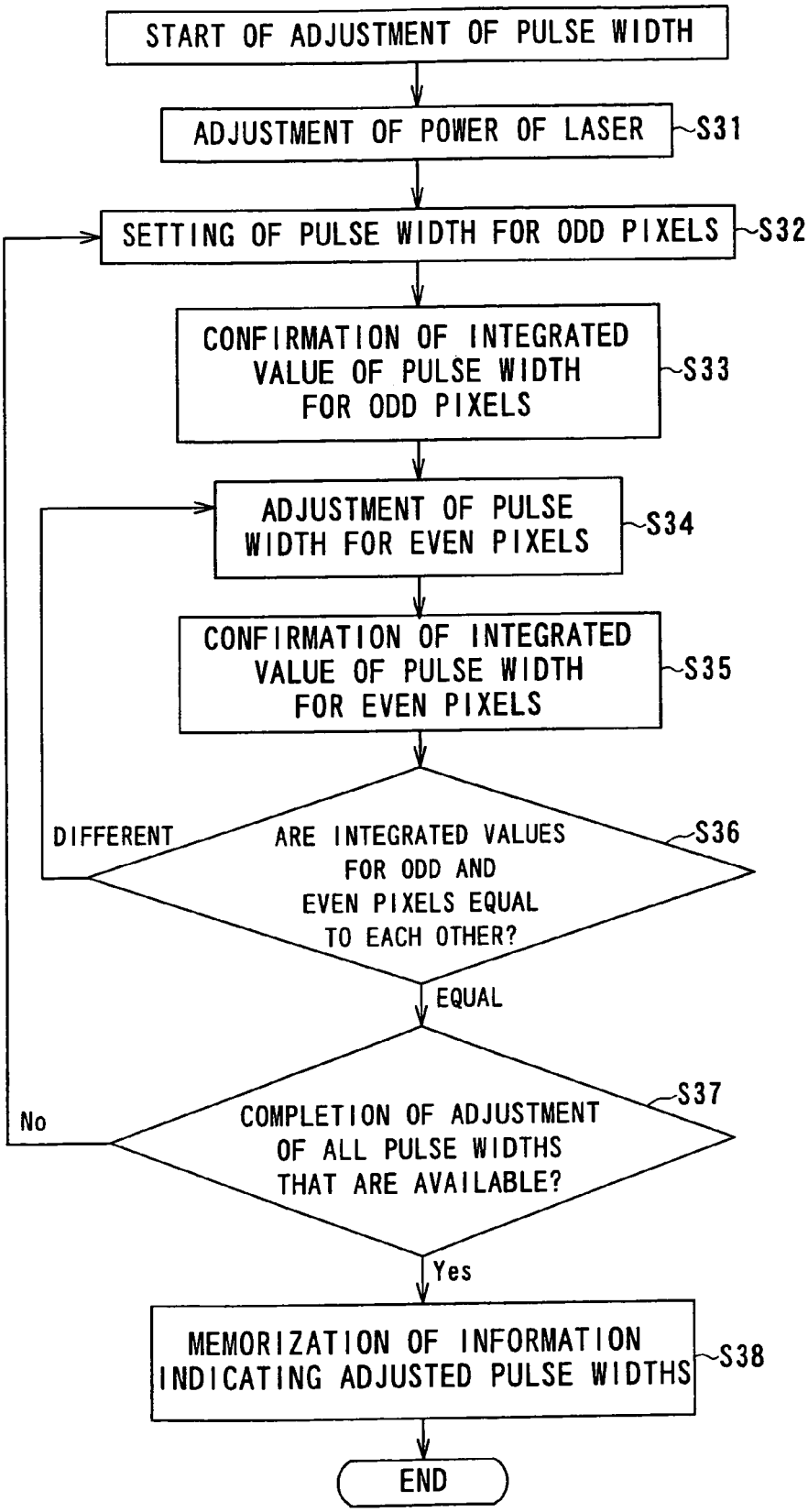
FIG. 10 is a flowchart outlining the processing for correction of irregularities in the width of a light beam pulse emitted at each pixel making up of a line, the processing is executed by a main controller employed in the second embodiment.
Figure 11:
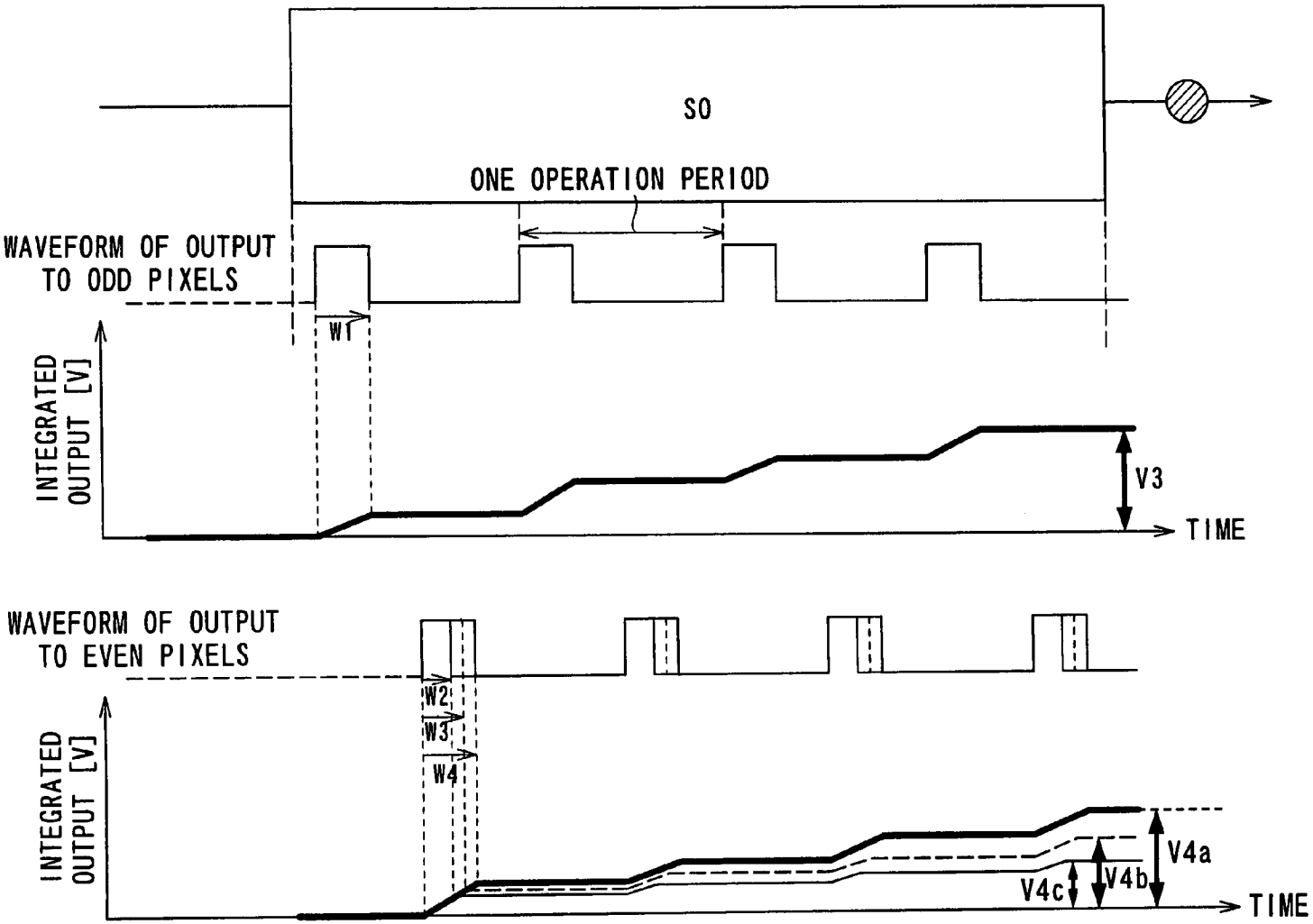
FIG. 11 is a view explaining the processing for the correction of the width of the light beam pulse in the second embodiment.

To cope with such drawbacks, the main controller 51 according to the present embodiment is able to perform the correction of irregularities in the pulse widths for each pixel at the time when the maintenance is carried out or the power is put on, as shown in FIG. 10.

To be specific, the main controller 51 starts performing the irregularity correction of the PWM outputs (pulse width adjustment). At first in this process, the power of the laser 31 is adjusted under predetermined conditions (step S31).

Then, while the light beam engages in scanning the sensor pattern SO of the light beam detector 38, the main controller 51 gives a specified width W1 (refer to FIG. 11) to a pulse to be directed to production of the odd pixels (step S32). With causing the laser 31 to emit light, every odd pixel, at a timing complying with the pulse width W1 so that the laser light beam is scanned in the line direction, the foregoing integrated value V3 is calculated using the output signal from the sensor pattern SO (step S33).

The main controller 51 then performs the same action as the above with the even pixels. That is, a certain pulse width W2 is set to calculate an integrated value V4 corresponding to the pulse width W2 (steps S34 and S35).

The main controller 51 proceeds to a process, in which integrated values V3 and V4 computed concerning both the strings of the odd and even pixels are compared with each other (step S36). When the pulse width W2 concerning the even-pixel string is less than the pulse width W1 concerning the odd-pixel string, the integrated value V4*c* (=Vc) concerning the even-pixel string becomes lower than the integrated value V3 concerning the odd-pixel string. However, when the pulse width W2 concerning the even-pixel string is larger than the pulse width W1 for the odd-pixel string, the integrated value V2 concerning the even-pixel string becomes larger than the integrated value V1 concerning the odd-pixel string.

Considering these situations, the main controller 51 returns its processing to step S34, where the main controller re-sets the pulse width W2 for each pixel of the even-pixel string. When this re-setting is carried out, the determination of V4(=V4*c*)<V3 in the last time allows the pulse width W2 to increase by a determined value ΔW in this re-resetting process. In other words, a pulse width of W3=W2+ΔW will be set. Therefore, as long as the determination of V4<V3 continues at step S36, the pulse width concerning the even-pixel pulse string is re-set to be larger, little by little, as being W3 to W4.

Whenever the re-setting is carried out, the main controller 51 calculates, at step S35, the integrated value V4 (=V4*b*, V4*a* . . . ) based on each of the pulse widths W3, W4 . . . for each pixel that has been reset. Thus, when both the integrated values V3 and V4 become equal to each other (V3=V4), the pulse width W1 concerning the odd-pixel string agrees with the pulse width W2 concerning with the even-pixel string (i.e., W1=W4 in FIG. 11), thus being determined YES at step S36. The agreement between both the pulse widths at this step includes an agreement with a certain tolerance. A series of adjustment processes described above will be executed for every pulse width to be used (step S37).

The main controller 51 then proceeds to a step in which the pulse widths W which have been adjusted equally to each other are stored in the memory 52 (step S38), and then terminates the irregularity correction (i.e., the pulse width adjustment).

Once a desired pulse width W is set as described above, the pulse width modulation circuit 70 is able to use the pulse width W as a reference value for actually forming images. Hence, in forming images, the widths of pulses modulated in accordance with image data and outputted in and from the pulse width modulation circuit 70 are based on the reference value, as to both the odd and even pixels. Therefore, like the first embodiment, the irregularities in depiction between the odd and even pixels which are due to use of the two pulse width modulation circuits 84 and 85 can be reduced with-steadiness, thus providing finer images.

Some modifications can also be provided in this embodiment. For example, like the first embodiment, the increment which is used for adjusting the pulse width may be set to a width corresponding to each of the divided widths achieved by the function of dividing one dot during depiction.

Further, in the foregoing embodiment, the pulse width for the even pixels has been adjusted to that for the odd pixels. However, this adjustment may be done in the opposite way, that is, the pulse width for the odd pixels may be adjusted to that for the even pixels.

Incidentally, the present invention is not limited to the configurations described in the above embodiments, but can further be reduced into practice in various modes derived from combinations with known art, by the person skilled in the art, without departing from the gist of the present invention claimed.

Furthermore, though the foregoing embodiments provide the configurations in which the functions which reduce the present invention into practice are previously kept in the apparatus, this is not a definitive list. Data that gives the same functions as the above may be downloaded to the apparatus via a network system. Alternatively, the same or similar functions may be given to a recording medium as data, so that the recording medium can be used to install the data from the medium to the apparatus. As such recording medium, any medium including CD-ROMs can be used, provided that program data can be memorized and the memorized data can be read by the apparatus. Furthermore, the data previously obtained through the foregoing installment or downloading may be configured to perform their functions in cooperation with an operating system (OS) in the apparatus.

What is claimed is:

1. A light beam scanning apparatus, comprising:

a modulator producing a modulated signal of a pulse width decided based on given image data;

a light generator capable of generating a light beam in response to the modulated signal;

a scanner periodically and spatially scanning the light beam generated by the light generator, along a second direction orthogonal to a predetermined first direction at a predetermined position in the first direction;

a power detector detecting information indicative of a power of the light beam scanned by the scanner; and a pulse width adjuster adjusting a pulse width of the light beam to be generated based on the information detected by the power detector, wherein the power detector is provided with a sensor receiving the light beam to output, as the information, an electrical signal depending on the received light beam, the sensor being spatially disposed at a position corresponding to a scanning position of the light beam in the first direction, wherein the light beam consists of a plurality of light beams, wherein the power detector detects the information by sequentially integrating each of the plurality of the light beams during a period in which the light beams pass through an area of the sensor, and wherein the pulse width adjuster is configured to adjust the pulse widths of the plurality of light beams which are to be generated so that the pulse widths of the light beams become equal to each other.

2. The apparatus according to claim 1, wherein the plurality of light beams are two light beams and a plurality of different positions to be scanned by the light beams in the first direction are two positions corresponding to mutually juxtaposed pixels in an image to be formed.

3. The apparatus according to claim 1, wherein the modulator is configured to produce a plurality of the modulated signals each assigned to each of the light beams, and the pulse width modulator is configured to adjust the pulse widths of the light beams to be generated depending on the plurality of modulated signals on the basis of the information detected by the power detector so that the pulse widths of the light beams become equal to each other.

4. The apparatus according to claim 1, comprising a power adjuster adjusting powers of the plurality of light beams based on the information detected by the power detector.

5. The apparatus according to claim 4, wherein the power adjuster is configured to adjust the powers of the plurality of light beams to be equal to each other.

6. The apparatus according to claim 1, comprising a beam scanning position adjuster adjusting the scanning position of the light beam so that the light beam scanned by the scanner necessarily passes the power detector.

7. The apparatus according to claim 1, comprising a memory in which an adjusted result of the pulse width performed by the pulse adjuster is preserved in a readable state.

8. A light beam scanning apparatus, comprising:

modulation means for producing a modulated signal of a pulse width decided based on given image data;

light generating means capable of generating a light beam in response to the modulated signal;

scanning means for periodically and spatially scanning the light beam generated by the light generating means, along a second direction orthogonal to a predetermined first direction at a predetermined position in the first direction;

power detecting means for detecting information indicative of a power of the light beam scanned by the scanning means; and pulse width adjusting means for adjusting a pulse width of the light beam to be generated based on the information detected by the power detecting means, wherein the power detecting means is provided with a sensor receiving the light beam to output, as the information, an electrical signal depending on the received light beam, the sensor being spatially disposed at a position corresponding to a scanning position of the light beam in the first directions, wherein the light beam consists of a plurality of light beams, wherein the power detecting means detects the information by sequentially integrating each of the plurality of the light beams during a period in which the light beam pass through an area of the sensor, and wherein the pulse width adjusting means is configured to adjust the pulse widths of the plurality of light beams which are to be generated so that the pulse widths of the light beams become equal to each other.

9. An image forming apparatus, comprising:

a modulator producing a modulated signal of a pulse width decided based on given image data;

a light generator capable of generating a light beam in response to the modulated signal;

a scanner periodically and spatially scanning the light beam generated by the light generator, along a second direction orthogonal to a predetermined first direction at a predetermined position in the first direction;

a power detector detecting information indicative of a power of the light beam scanned by the scanner; and a pulse width adjuster adjusting a pulse width of the light beam to be generated based on the information detected by the power detector, wherein the power detector is provided with a sensor receiving the light beam to output, as the information, an electrical signal depending on the received light beam, the sensor being spatially disposed at a position corresponding to a scanning position of the light beam in the first direction, wherein the light beam consists of a plurality of light beams, wherein the power detector detects the information by sequentially integrating each of the plurality of the light beams during a period in which the light beams pass through an area of the sensor, and wherein the pulse width adjuster is configured to adjust the pulse widths of the plurality of light beams which are to be generated so that the pulse widths of the light beams become equal to each other.

10. The apparatus according to claim 9, comprising a memory in which an adjusted result of the pulse width performed by the pulse adjuster is preserved in a readable state.

* * * * *